US010619885B2

(12) United States Patent
Sagström et al.

(10) Patent No.: US 10,619,885 B2
(45) Date of Patent: Apr. 14, 2020

(54) AIRFLOW CONTROL DEVICE

(71) Applicant: Elipcon AB, Jönköping (SE)

(72) Inventors: Tobias Sagström, Jönköping (SE); Fredrik Ekstrand, Jönköping (SE)

(73) Assignee: Elipcon AB, Jönköping (SE)

( * ) Notice: Subject to any disclaimer, the term of this patent is extended or adjusted under 35 U.S.C. 154(b) by 231 days.

(21) Appl. No.: 15/742,690

(22) PCT Filed: Jul. 1, 2016

(86) PCT No.: PCT/EP2016/065517
§ 371 (c)(1),
(2) Date: Jan. 8, 2018

(87) PCT Pub. No.: WO2017/009071
PCT Pub. Date: Jan. 19, 2017

(65) Prior Publication Data

US 2018/0195756 A1 Jul. 12, 2018

(30) Foreign Application Priority Data

Jul. 10, 2015 (EP) ..... 15176203

(51) Int. Cl.

| | |
|---|---|
| ***F24F 7/00*** | (2006.01) |
| ***F24F 13/10*** | (2006.01) |
| ***F24F 13/02*** | (2006.01) |
| ***F24F 13/14*** | (2006.01) |

(52) U.S. Cl.
CPC ..... *F24F 13/10* (2013.01); *F24F 13/02* (2013.01); *F24F 13/0218* (2013.01); *F24F 13/14* (2013.01)

(58) Field of Classification Search
CPC ..... F16K 7/02; F16K 7/08; F16K 7/10; F24F 13/0218
USPC ..... 454/333; 137/853, 315.07; 251/9–10
See application file for complete search history.

(56) References Cited

U.S. PATENT DOCUMENTS

| | | | | |
|---|---|---|---|---|
| 1,108,128 A * | 8/1914 | Huffum | ..... | G05D 7/012 138/45 |
| 3,102,710 A * | 9/1963 | Dresden | ..... | A01G 25/16 251/9 |
| 5,275,333 A | 1/1994 | Tamblyn | | |

FOREIGN PATENT DOCUMENTS

| | | |
|---|---|---|
| DE | 19825407 A1 | 12/1990 |
| EP | 2492606 A1 | 8/2012 |
| JP | S58206412 A | 12/1983 |

(Continued)

OTHER PUBLICATIONS

International Search Report and Written Opinion from International Application No. PCT/EP2016/065517, dated Sep. 7, 2016 (9 pages).

*Primary Examiner* — Vivek K Shirsat
(74) *Attorney, Agent, or Firm* — Kagan Binder, PLLC

(57) ABSTRACT

Airflow control device (1) for use in an air handling system, which comprises an outer tube (2) and at least one inner tube (3) arranged inside the outer tube (2). The inner tube (3) is at least partly made of flexible material and has an axial opening (4) through which air is adapted to flow. The inner tube (3) further exhibits an inlet part (8) and an outlet part (10), and a throttle part (9) between the inlet part and the outlet part. The device (1) is characterized by a pivotable throttling device (7) which is arranged to impact the inner tube (3), and thereby control the airflow through the inner tube (3), by rotation around a second pivot axis (b).

10 Claims, 2 Drawing Sheets

(56) References Cited

FOREIGN PATENT DOCUMENTS

JP 2000241010 A 9/2000

* cited by examiner

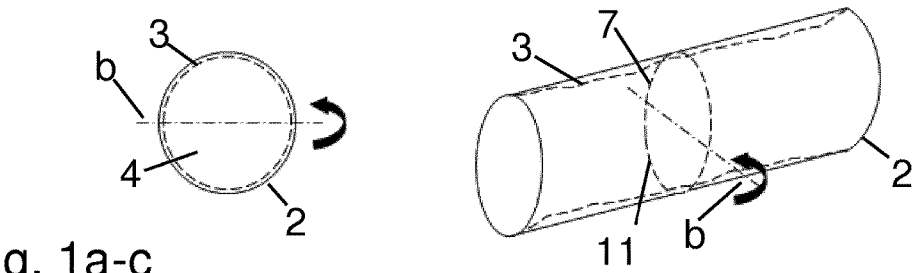
Fig. 1a-c
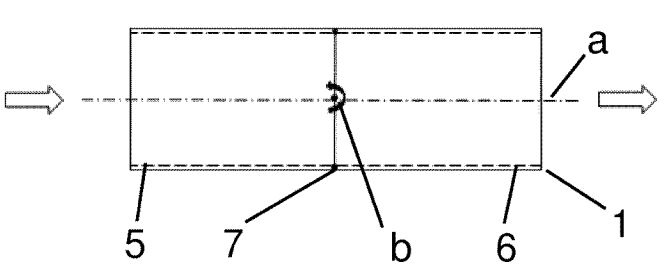
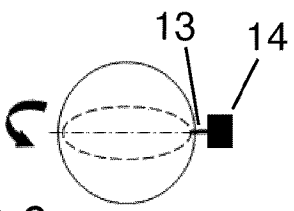
Fig. 2a-c
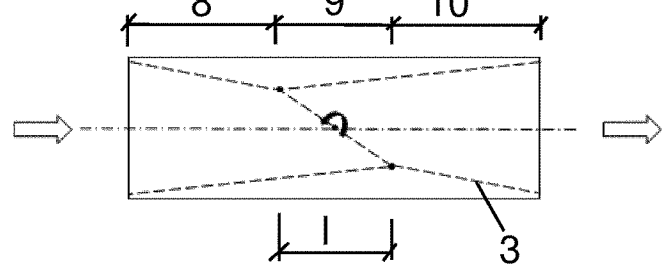
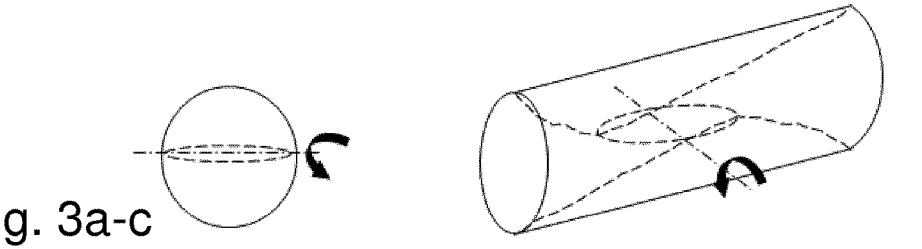
Fig. 3a-c
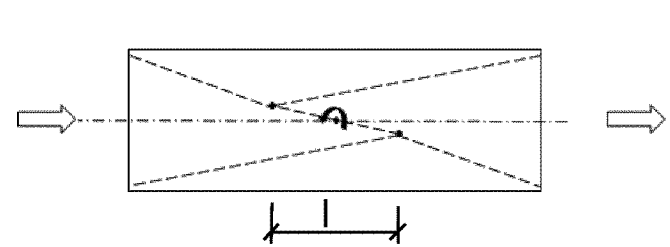
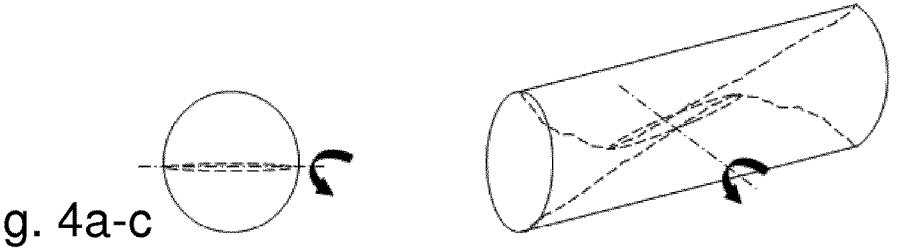
Fig. 4a-c
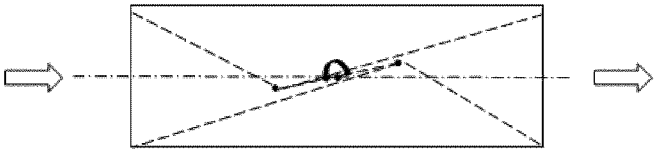

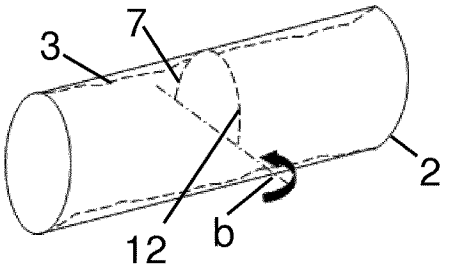
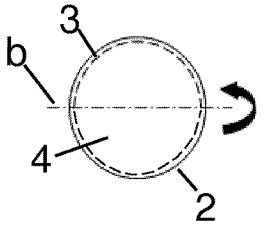
Fig. 5a-c
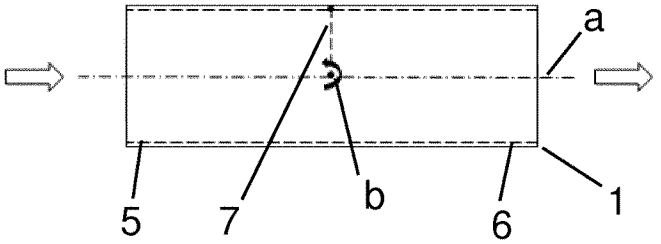
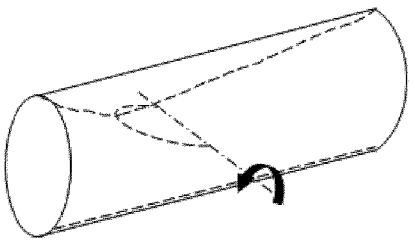
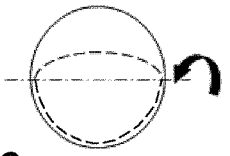
Fig. 6a-c
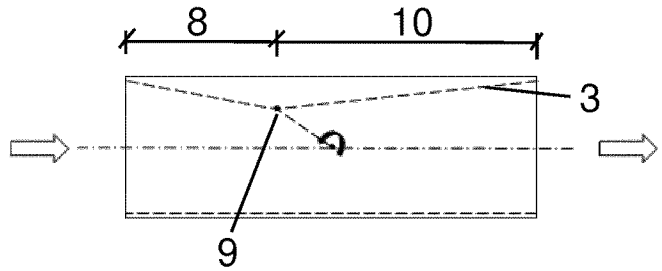
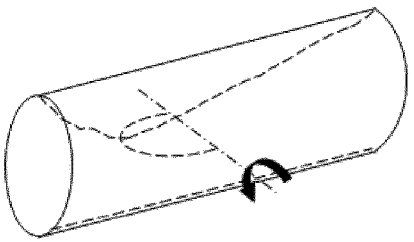
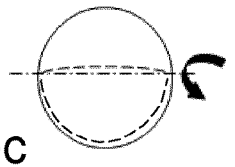
Fig. 7a-c
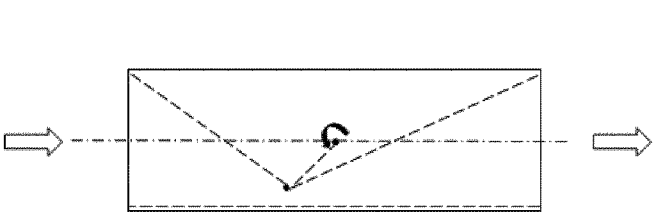
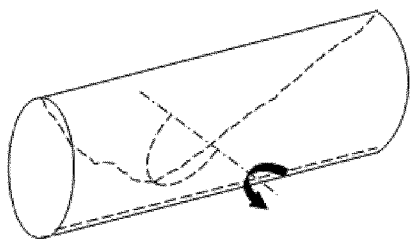
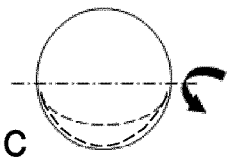
Fig. 8a-c

AIRFLOW CONTROL DEVICE

CROSS-REFERENCE TO RELATED APPLICATIONS

This application claims priority to International Application No. PCT/EP2016/065517, filed Jul. 1, 2016, and titled "AIRFLOW CONTROL DEVICE", which in turn claims priority from European Application having Ser. No. 15/176,203.6, filed on Jul. 10, 2015, both of which are incorporated herein by reference in their entireties.

FIELD OF INVENTION

Present invention relates to an airflow control device for use in the field of ventilation, and provides a simple, cost efficient and very silent airflow control device compared to existing control devices like the IRIS-damper or conventional blade dampers.

BACKGROUND OF THE INVENTION

In the field of ventilation airflow control is essential and many airflow control devices/dampers are known. A very simple and cost efficient type is the so-called blade damper. This damper consists of a rotatable blade arranged inside an outer tube, and which blade can be rotated around a rod fitted in the outer tube. Preferably the blade comprises a sealing around its periphery to prevent leakage in the closed position. By rotating the blade, more or less of the airflow passage is covered by the blade and thereby it is possible to control or stop the airflow passing through the tube. Unfortunately this damper type causes a lot of turbulence of the airflow and thereby a lot of noise which are unwanted characteristics and a problem within ventilation.

Another well-known damper is the so-called IRIS-damper, which changes the size of the airflow passage via an iris-like radial movement of a number of thin steel sheet blades. This is a good solution for controlling the airflow, but unfortunately also a very noisy solution with a complex and cost driving design.

A recent solution is presented in EP 2 492 606 A1, which is an airflow adjustment device for arrangement in an air ventilation arrangement, and which comprises an outer tube, an inner tube arranged inside the outer tube and rotationally and axially moveable relative to the outer tube. Further the device comprises a twist tube with an axial opening through which air is adapted to flow. The twist tube is fixed relative to the outer tube with one end and attached to the inner tune at the second end. The inner tube is adapted to be rotated and displaced relative to the outer tube and when the inner tube is rotated the twist tube is twisted and the size of the axial opening is changed. This device is far better regarding noise compared to the previous presented devices, but it has a complicated design and is therefore expensive to manufacture. For all the above described prior art solutions a consequence of increased throttling, i.e. the closing of the damper, is increased turbulence and thereby increased noise.

Because of the above described shortcomings of existing dampers there is a need for a simple and cost-efficient air control device with better characteristics regarding noise and airflow control, preferably over a wide range of airflows for the specific size of the airflow control device.

DISCLOSURE OF THE INVENTION

It is an object of the present invention to provide a solution which overcomes the problems stated above and this is achieved by an airflow control device as described below. The airflow device comprises an outer tube and at least one inner tube, arranged inside the outer tube, and which inner tube at least partly comprises flexible material. The air is adapted to flow through an axial opening of the inner tube. The inner tube further comprises an inlet part and an outlet part, and a throttle part between the inlet part and the outlet part. The inlet part, throttle part and outlet part may together form the shape of the inner tube. The inner tube comprises a central axis. By the throttle part being located between the inlet part and the outlet part it may be meant that the throttle part is arranged between the inlet part and the outlet part along the central axis of the inner tube. The inner tube may be aligned with the outer tube to have a common central axis of the device which also is common with the airflow direction through the device. To regulate the airflow through the device, a pivotable throttling device is arranged to impact the inner tube by a rotational movement around a pivot axis. When the throttling device is rotated around its pivot axis the form of the inner tube changes by the influence of the throttling device and thereby airflow through axial opening of the inner tube is controlled. This is possible because the inner tube or at least a part of the inner tube is made of flexible material. The pivot axis is perpendicular or at least near perpendicular in relation to the central axis of the inner tube. By this configuration a combination of advantages are achieved both according to manufacture aspects and flow control aspects. As described above is the known blade damper cost-efficient, and the benefits from that design is used in the present invention through the pivotable design of the throttling device. The pivot/rotation movement is easy to apply and control. Further the advantages from the recent solution presented in EP 2 492 606 A1 is at least partly used, by that the inner tube is made of flexible material, or at least partly made of flexible material. By allowing the throttling device to impact the flexible inner tube, instead of directly impact the air stream, a smooth and gentle throttling is achieved, with positive characteristics according to turbulence and noise. Depending of the specific design (different embodiments are described below) of the throttling device it is possible to achieve a controlled and tested design of the inlet part, the throttle part and the outlet part of the inner tube, with preferred pressure loss and sound characteristics. This solution provides a smooth airflow passage through the device with no sharp edges like for example the blade damper. Further, the deflecting of the air stream that occurs in all throttle solutions and which causes the turbulence at the throttle part, is controlled and not that abrupt as in prior art solutions, because of the smooth passage through the inlet part, the throttle part and the outlet part by the indirect and pivoting arrangement. The present invention is causing less noise and has a very simple construction and is thereby, more cost-efficient compared to prior art solutions.

According to an embodiment of the invention the pivotable throttling device is arranged between the outer tube and the flexible inner tube. By rotating the throttling device around its pivot axis the inner tube is effected from the outside and inwards towards the centre. The impact from the outside together with the flexible material in the inner tube provides smooth transitions to the inlet part, the throttle part and the outlet part, which is positive for pressure loss, turbulence and sound. This embodiment is preferably performed with a thin throttling device which then may be arranged between the outer and the inner tube without any particular impact on the respective cross-sections of the tubes, but it may also be a thicker throttling device with a certain impact for example on the inner tube. This could be an alternative if a design pressure loss is wanted in the specific case.

According to an alternative embodiment the pivotable throttling device is arranged inside the inner tube. By this arrangement the inner tube is for example has a smaller cross-section in the unaffected state or is of collapsible material, and the inner tube is in this case expanded to its open position by the throttling device and collapses/throttles while rotating the throttling device to a more throttled airflow. Preferably the throttling device is thin or designed in way to not causing noise or other unwanted characteristics.

According to another alternative embodiment the pivotable throttling device is arranged inside a pocket or pocket-like arrangement at the inner tube. To avoid that the material of inner tube is torn, it may be wise to arrange the throttling device inside a tight pocket arranged at the inner tube, which prevents the throttling device from sliding over the surface of the inner tube. If this is not a problem, i.e. the material can withstand some wear, or if the pocket is made of durable material, the pocket can be elongate and the throttling device can slide inside the pocket. The same advantages regarding flow and sound characteristics as the above described embodiments are at hand also in this embodiment.

In another embodiment of the invention the inlet part and the outlet part of the inner tube respectively exhibits an asymmetrical cone shape during throttling by the throttling device. This means that the as soon the throttling is initiated the respective cone gets a grade of asymmetry, i.e. has a portion of steeper walls which gradually turns into a flatter portion of the inlet/outlet cone. By this the turbulence around the throttle part is in most cases decreased, which is positive regarding pressure and sound characteristics.

In a further embodiment of the invention the throttling device is designed as a wire or a wire-like design, and thereby thin. A thin throttling device makes as little impact on the cross-section of both the outer tube and the inner tube. The outer tube may in that case be an ordinary duct-type with no extra space provided for the throttling device. Also the inner tube may have almost the same cross-section as the outer tube, just slightly smaller to fit inside the outer tube. This means that both the outer and the inner tube may be designed as simple and production-friendly tube which is cost-efficient, and any turbulence that may occur is minimal, compared to prior art solutions. The wire-like design may comprise any kind of material such as plastic, steel-wire, rubber, etc.

In an alternative embodiment the throttle device is designed from steel sheet material which makes it possible to produce a thin throttling device similar to the wire-like design presented above.

In one embodiment the inner tube comprises a first end and a second end which are respectively attached in the outer tube, at a distance from each other. This means that the inner tube is formed by attachment to the outer tube. If the inner tube is made of stretchable material the inner tube is preferably stretched out and fixed near the ends of the outer tube to form the inner tube, and the throttling device thereby can flex the inner tube during throttling, while the ends of the inner tube are fixed. If the inner tube is flexible, or partly flexible, but not stretchable, the fastening of the ends to the outer tube still doesn't exclude that the inner tube can be throttled by the throttling device in the flexible part.

In an embodiment the throttling device is designed as a pivotable ring, which is pivotally mounted in the outer tube and pivotable around the pivot axis. The ring is easy to manufacture and also easy to apply pivotally inside the outer tube. Further, the ring-form provides in a throttled position an inlet part, a throttle part, and an outlet part of the inner tube where the inlet part and the outlet part are asymmetrical and cone shaped. Also, the inlet and outlet parts are inverted, which in tests has proven positive for turbulence and noise characteristics. The good test results are also achieved by that the throttle part mainly exhibits a form of a straight duct, because of that the ring is symmetrical, i.e. two symmetrical arcs that affects the inlet part and the outlet part. Tests have also showed that increased throttling doesn't dramatically impair noise characteristics like in prior art solutions.

In one embodiment, the axial length of the throttle part increases the more the throttling of the airflow is performed. This means that when the axial opening accessible for airflow through the device decreases, the longer the throttle part gets. As mentioned above, the throttle part mainly exhibits a form of a straight duct, which gets a more even flow profile the longer "duct" gets, which is proven positive during testing of the product. This also means that the noise caused by throttling doesn't increase as dramatic as in prior art solutions. I.e. the airflow through the throttle part may be straight, even though it follows a line having an angle towards the central axis of the inner tube. The airflow is curved when entering the throttle part from the inlet part, and when leaving the throttle part to the outlet part. By throttling, the length and width of the throttle part may be changed.

An alternative to the above presented ring is in a half ring—a pivotable arc, which is pivotable around the pivot axis in the same way as the ring. This is an even more cheap solution and provides the possibility to choose whether to rotate the arc in direction "towards" the airflow or "with" the airflow direction, which may be of importance for sound characteristics. Further, the pivotable arc may be formed as part of a ring being more or less than a half ring.

To be able to rotate the throttling device arranged inside the outer tube, the throttling device is connected to a rotatable shaft according to one embodiment. The shaft is accessible from the outside of the outer tube and a rotation of the shaft rotates the throttling device and thereby changes the airflow through the device. The shaft may extend from the throttling device radially outward through the outer tube. In an embodiment wherein the throttling device is arranged inside the inner tube, or in a pocket in connection to the inner tube, the shaft may extend also through the inner tube.

According to a further embodiment the shaft is connected to an actuator for the possibility to automatically control the airflow through the device. Through the simple design of the complete airflow control device it is very easy to apply an actuator of standard type and also the pivoting movement of the throttling device makes it easy to control the airflow with a low power actuator.

According to another embodiment, the flexible material of the inner tube comprises fabric, textile, cloth, plastics, rubber or the like. The flexible material may be configured to be bendable or twistable by the throttling device to control the airflow. A flexible material of plastics or rubber may comprise thin plastics or rubber flexible such as fabric, textile or cloth.

By the invention a number of advantages compared to known solutions are obtained:

- A simple and cost efficient design with few parts and easy to manufacture.
- A very silent air control device with better sound characteristics compared to most prior art solutions.

A designable form of the airflow passage by different types of throttling devices.

Easy to clean due to that the throttle part is completely openable.

Easy to control by an actuator.

BRIEF DESCRIPTION OF THE DRAWINGS

FIG. 1*a-c* shows a first embodiment of the airflow control device 1 in a cross section, a perspective view and a section, when the device is in an open position.

FIG. 2*a-c* shows a first embodiment of the airflow control device 1 in a cross section, a perspective view and a section, when the device is in a slightly throttled position.

FIG. 3*a-c* shows a first embodiment of the airflow control device 1 in a cross section, a perspective view and a section, when the device is in a more throttled position than in FIG. 2*a-c*.

FIG. 4*a-c* shows a first embodiment of the airflow control device 1 in a cross section, a perspective view and a section, when the device is in a nearly closed position.

FIG. 5*a-c* shows a second embodiment of the airflow control device 1 in a cross section, a perspective view and a section, when the device is in an open position.

FIG. 6*a-c* shows a second embodiment of the airflow control device 1 in a cross section, a perspective view and a section, when the device is in a slightly throttled position.

FIG. 7*a-c* shows a second embodiment of the airflow control device 1 in a cross section, a perspective view and a section, when the device is in a more throttled position than in FIG. 6*a-c*.

FIG. 8*a-c* shows a second embodiment of the airflow control device 1 in a cross section, a perspective view and a section, when the device is in a nearly closed position.

The constructive design by the present invention is obvious in the following description in detail of examples of embodiments of the invention related to the accompanying figures showing a first and second, but not limiting examples of embodiments of the invention. In addition the invention forwards the prior art in the field in different aspects. This is realized in the present invention by that the device of the below described art principally is constituted in a way that is obvious from the characterised part of claim 1.

DETAILED DESCRIPTION OF THE DRAWING

FIG. 1*a-c* shows a preferred embodiment of the airflow control device 1 with an outer tube 2 and an inner tube 3 of flexible material arranged inside the outer tube 2. The tubes 2, 3 are aligned around a common first central axis a. In the preferred embodiment the inner tube 3 has a cross section slightly smaller than the outer tube 2, but smaller dimensions of the inner tube 3 is also possible. The airflow control device 1 is further arranged with a throttling device 7, which is arranged between the outer tube 2 and the flexible inner tube 3 and pivotable around a second pivot axis b. The second pivot axis b is perpendicular, or close to perpendicular in relation to the first device axis a. In other words, the second pivot axis b is arranged substantially perpendicular to an intended airflow direction through the device 1. By that the throttling device 7 is arranged between the outer tube 2 and the inner tube 3 it may press the inner tube 3 from its periphery and inwards when throttling, by a rotational motion around the second pivot axis b. Further, the throttling device 7 is thin not to impact the inner tube 3 more than necessary. In the preferred embodiment the throttling device 7 is designed as a pivotable ring 11, which is pivotally mounted in the outer tube 2. In this embodiment the ring 11 is not attached at the inner tube 3, but instead free to slide along the outer surface of the inner tube 3 during throttling/opening. The throttling device 7 may have any kind of wire-like design and consist of steel wire, rubber, plastic or similar, or for example consist of a thin steel sheet ring form. The throttling device 7, i.e. the ring 11 is in an open position, wherein an axial opening 4 of the inner tube 3 is fully open for airflow through the inner tube 3. The airflow direction is shown by arrows in FIG. 1*c*. It is preferred that a first end 5 and a second end 6 is respectively attached at the corresponding ends, or near the ends of the outer tube 2, and thereby at a distance from each other, preferably to form the shape of the inner tube 3. For example, the inner tube 3 may comprise stretchable material which is fixedly attached to one end of the outer tube 2 and then stretched and fixed to the other end to form the inner tube 3 in an appropriate way. Another option is that the inner tube 3 isn't stretchable, but anyway flexible, and thereby allowing the ring 11 to impact the material to throttle the inner tube 3. The inner tube 3 may also be a "stand alone" inner tube 3 which is insertable in the outer tube 2 as a self-carrying flexible tube inside the outer tube 2.

As explained above is the ring 11 arranged between the outer tube 2 and the inner tube 3, but other alternatives are possible within the scope of the invention. For example, the ring 11 may be arranged inside a tight pocket or an elongated pocket, which is fitted on the inner tube 3. Another alternative may be a ring 11 arranged inside the inner tube 3. The latter option could for example be a stretched inner tube 3 of a small diameter, which then is widened by the ring 11 in the open position and then by the stretch and the smaller diameter will "collapse" during throttling.

FIG. 2*a-c* shows the device 1 as described in FIG. 1*a-c*, where the throttle device 7, i.e. the ring 11 is in a slightly throttled position. In FIG. 2*a* the ring 11 is pivotally mounted in the outer tube 2 and also connected to a rotatable rod 13, which in turn is connected to an actuator 14. This is a simple solution for automatic regulation of the airflow, with known devices for motorization of the device 1. When throttling, the ring 11 directly comes in contact with the inner tube 3 from the open position and further slides along the inner tube 3, which is pushed from the outside and inwards and in a throttled position the inner tube 3 exhibits an inlet part 8, a throttle part 9, and an outlet part 10, as seen in FIG. 2*b-c*. It can also be seen that the inlet part 8 and the outlet part 10 exhibits an asymmetrical cone shape, which in tests proven positive for turbulence and noise characteristics. The good test results are also achieved by that the throttle part 9 mainly exhibits a form of a straight duct, which is more visible in FIG. 3*c*, below. Tests have also showed that increased throttling doesn't dramatically impair noise characteristics like in prior art solutions.

FIG. 3*a-c* shows the device 1 as described in FIG. 1*a-c*, where the ring 11 is in a more throttled position than in FIG. 2*a-c*. It can still be seen that the inlet part 8 and the outlet part 10 exhibits an asymmetrical cone shape and also that the throttle part 9 mainly exhibits a form of a straight duct. Compared to FIG. 2*c*, it also can be seen that the length of the throttle part 9 is increasing the more the throttle device 7 is throttled, which means that less turbulence is achieved in the throttle part 9 as the flow passage is getting longer, which is positive for noise characteristics.

FIG. 4*a-c* shows the device 1 as described in FIG. 1*a-c*, where the throttle device 7, i.e. the ring 11 is in a nearly closed position. It is fully possible to close the airflow control device 1 totally.

FIG. 5*a-c* shows an alternative embodiment of the airflow control device 1 with a similar design as described above with reference to FIGS. 1-4. The difference is that the throttling device 7 is a pivotable arc 12, instead of a ring. The arc 12 is pivotable around the second pivot axis b in the same way as the ring. The function and the possible variants of how to arrange the pivotable arc 12 is applicable also with this variant in the same way as it is at the ring-type (outside, inside, pocket etc.). In the upright position, the airflow control device 1 is open for airflow through the axial opening 4 in the inner tube 3.

FIG. 6*a-c* shows the device 1 as described in FIG. 5*a-c*, where the throttle device 7, i.e. the arc 12 is in a slightly throttled position. The arc-design gives another shape of the inner tube 3 compared to the ring-design. While the ring-design gives a similar but inverted inlet part 8 compared to outlet 10 part, with an elongated throttle part 9 in between, the arc 12 gives an inlet part 8 which differs from the outlet part 10, and the throttle part 9 is just the exact narrowest part, which is not elongated. The arc-design of the throttling device 7 gives a possibility to choose whether the pivoting motion of the arc 12 should be towards the air flow direction or along the same, which may be of importance for noise reduction. Still, the inlet part 8 as well as the outlet part 10 of the inner tube 3 exhibits an asymmetrical cone shape.

FIG. 7*a-c* shows the device 1 as described in FIG. 5*a-c*, where the arc 12 is in a more throttled position than in FIG. 6*a-c*. Compared to FIG. 6*c* it can be seen that the throttling part is moved both in direction towards the airflow direction and also in a radial direction, which means that the inlet part 8 is getting shorter the more throttling of the airflow, while the outlet part 10 is getting longer.

FIG. 8*a-c* shows the device 1 as described in FIG. 5*a-c*, where the throttle device 7, i.e. the arc 12 is in a nearly closed position. It is fully possible to close the airflow control device 1 totally.

PARTS LIST

1=airflow control device
2=outer tube
3=inner tube
4=axial opening
5=first end
6=second end
7=throttling device
8=inlet part
9=throttling part
10=outlet part
11=pivotable ring
12=pivotable arc
13=rotatable shaft
14=actuator

The invention claimed is:

1. Airflow control device for use in an air handling system, which airflow control device comprises an outer tube, and further at least one inner tube arranged inside the outer tube, which inner tube at least partly is made of flexible material, the inner tube has an axial opening through which air is adapted to flow, and the inner tube further comprising an inlet part and an outlet part, and a throttle part between the inlet part and the outlet part, the airflow control device further comprising a pivotable throttling device which is arranged to impact the inner tube, and thereby control the airflow through the inner tube, by rotation around a pivot axis, which pivot axis is at least near perpendicular to a central axis of the inner tube;

wherein the pivotable throttling device is a pivotable arc which is pivotally mounted in the outer tube, wherein the pivotable are is arranged inside the inner tube or between the outer tube and the inner tube.

2. The airflow control device according to claim 1, wherein the inlet part and the outlet part respectively exhibits an asymmetrical cone shape during throttling by the throttling device.

3. The airflow control device according to claim 1, wherein the throttling device is wire shaped.

4. The airflow control device according to claim 1, wherein the throttling device is made of steel sheet material.

5. The airflow control device according to claim 1, wherein the inner tube comprises a first end and a second end which are respectively attached at corresponding ends of the outer tube.

6. The airflow control device according to claim 1, wherein the throttling device is a pivotable ring which is pivotally mounted in the outer tube.

7. The airflow control device according to claim 1, wherein the length of the throttle part increases while the radial size of the axial opening decreases during throttling.

8. The airflow control device according to claim 1, wherein the throttling device is connected to a rotatable shaft, accessible from outside the outer tube.

9. The airflow control device according to claim 8, wherein the rotatable shaft is connected to an actuator, for controlling the airflow through the airflow control device.

10. The airflow control device according to claim 1, wherein the flexible material of the inner tube comprises fabric, textile, cloth, plastics or rubber.

* * * * *